US007162816B2

(12) United States Patent
Otsuka et al.

(10) Patent No.: US 7,162,816 B2
(45) Date of Patent: Jan. 16, 2007

(54) WORK VEHICLE WITH TILT FLOOR

(75) Inventors: Kinichi Otsuka, Tokyo (JP); Toshifumi Ogihara, Tokorozawa (JP); Katsumi Yokoo, Ageo (JP); Sachio Shimizu, Sayama (JP)

(73) Assignees: Komatsu Ltd., Tokyo (JP); Komatsu Zenoah Co., Kawagoe (JP)

( * ) Notice: Subject to any disclaimer, the term of this patent is extended or adjusted under 35 U.S.C. 154(b) by 230 days.

(21) Appl. No.: 10/685,581

(22) Filed: Oct. 16, 2003

(65) Prior Publication Data

US 2004/0172863 A1 Sep. 9, 2004

(30) Foreign Application Priority Data

Oct. 23, 2002 (JP) ..... 2002-308696
May 20, 2003 (JP) ..... 2003-142648
Sep. 25, 2003 (JP) ..... 2003-334158

(51) Int. Cl.
*B62D 33/06* (2006.01)

(52) U.S. Cl. ..... 37/347; 180/89.19; 180/89.18

(58) Field of Classification Search ..... 37/347; 180/89.17, 89.18, 69.21, 89.19, 89.14
See application file for complete search history.

(56) References Cited

U.S. PATENT DOCUMENTS 2,931,452 A * 4/1960 Mackie ..... 180/69.21
3,981,375 A * 9/1976 Crawford ..... 180/69.21
4,040,501 A 8/1977 Haswell
4,076,302 A * 2/1978 Sable ..... 296/65.06
4,401,179 A * 8/1983 Anderson ..... 180/89.14
4,785,900 A * 11/1988 Nasky ..... 180/89.14
4,811,983 A * 3/1989 Watts et al. ..... 296/190.05
5,199,521 A * 4/1993 Samejima et al. ..... 180/68.1
5,551,826 A * 9/1996 Todd et al. ..... 414/685
5,671,820 A * 9/1997 Kobayashi et al. ..... 180/68.1
6,048,018 A * 4/2000 Shambeau et al. ..... 296/57.1
6,357,820 B1 * 3/2002 Nagatsuka et al. .... 296/190.06
6,543,563 B1 * 4/2003 Muraro ..... 180/89.12

FOREIGN PATENT DOCUMENTS

| | | | |
|---|---|---|---|
| DE | 3816094 | * | 11/1989 |
| EP | 355345 | * | 2/1990 |
| EP | 0727529 | | 8/1996 |
| JP | 54-120018 | | 9/1979 |
| JP | 55-53680 | | 4/1980 |
| JP | 58-111675 | | 7/1983 |
| JP | 60-035673 | | 2/1985 |
| JP | 57077273 | * | 5/1985 |
| JP | 60099773 | * | 6/1985 |
| JP | 62-65321 | | 4/1987 |
| JP | 02-011733 | | 1/1990 |

(Continued)

*Primary Examiner*—Thomas A Beach
(74) *Attorney, Agent, or Firm*—Posz Law Group, PLC; R. Eugene Varndell, Jr.

(57) ABSTRACT

A work vehicle with a tilt floor, which is capable of improving the maintainability around an engine and the operability and comfortability of a driver's seat and its periphery, is provided. The work vehicle with a tilt floor includes a hinge mechanism which is provided on the front end of the tilt floor to enable to turn the tilt floor toward the front of the vehicle body, the rear of the tilt floor is formed to be higher than the front of the tilt floor so to cover the headroom of an engine disposed on the rear of the vehicle body, and an operator seat is disposed on the top surface at the rear of the tilt floor.

9 Claims, 18 Drawing Sheets

FOREIGN PATENT DOCUMENTS

| | | | |
|---|---|---|---|
| JP | 06008858 | * | 1/1994 |
| JP | 6-11909 | | 3/1994 |
| JP | 06-064562 | | 3/1994 |
| JP | 08-058633 | | 3/1996 |
| JP | 09-025649 | | 1/1997 |
| JP | 09-328781 | | 12/1997 |
| JP | 10-140607 A1 | | 5/1998 |
| JP | 11-269928 | | 5/1999 |
| JP | 2000-72048 | | 3/2000 |
| JP | 2000-118448 | | 4/2000 |
| JP | 2000-309946 | | 11/2000 |
| JP | 2001-064997 | | 3/2001 |
| JP | 2001-130451 | | 5/2001 |

* cited by examiner

WORK VEHICLE WITH TILT FLOOR

BACKGROUND OF THE INVENTION

1. Field of the Invention

The present invention relates to a work vehicle provided with a tilt floor.

2. Description of the Related Art

FIG. 18 is a side view showing an example of a conventional work vehicle, namely a small hydraulic excavator 100. In FIG. 18, the small hydraulic excavator 100 as a work vehicle has an excavating working device 90 at the front end and a counterweight 50 at the rear end so to keep a balance of the small hydraulic excavator 100 when a load is applied to the working device 90. The counterweight 50 has a canopy mounting bracket 201 at the top end for mounting a canopy 20 on the bracket 201. An operator seat 30 is mounted on a floor at the front or on the side of a space for mounting an engine 40 and the like.

For example, Japanese Patent Application Laid-Open No. 10-140607 (pages 2–5 and FIGS. 1–6) shall be referenced.

But, the counterweight 50 has the canopy mounting bracket 201 on its top end to secure the canopy 20 to the bracket 201 as shown in FIG. 18, so that the top of the counterweight 50 cannot be opened. Therefore, the maintainability of the engine 40 and the like mounted in front of the counterweight 50 is poor. And, the operator seat 30 is disposed on the top of the floor at the front or on the side of the space where the engine 40 is mounted. But, a small work vehicle which is used in a small work site is limited to have small outer dimensions, so that when the space required to mount the engine is secured at the rear of the vehicle, a foot space on the side or at the front of the operator seat 30 becomes small, and there are problems in operability and comfortability.

SUMMARY OF THE INVENTION

The present invention has been made in view of the above circumstances and provides a work vehicle with a tilt floor, which improves the maintainability of the engine and its periphery and the operability and comfortability around the driver's seat.

A first aspect of the invention relates to a work vehicle provided with a tilt floor, wherein a hinge mechanism is provided on a front end of the tilt floor to enable to turn the tilt floor toward a front of a vehicle body, a rear of the tilt floor is formed to be higher than the front of the tilt floor so to cover a headroom of an engine disposed on a rear of the vehicle body, and an operator seat is disposed on a top surface at the rear of the tilt floor.

According to the first aspect of the invention, the hinge mechanism is provided on the front end of the tilt floor to enable to turn the tilt floor toward the front of the vehicle body, the rear of the tilt floor is formed to be higher than the front of the tilt floor so to cover the headroom of the engine which is mounted on the rear of the vehicle body, and the operator seat is disposed on the top surface at the rear of the tilt floor. Therefore, when the tilt floor is tilted toward the front of the vehicle body by the hinge mechanism, the headroom of the engine is opened widely, and the maintainability around the engine is improved.

As described above, the rear of the tilt floor is formed to cover the headroom of the engine which is mounted on the rear of the vehicle body, and the operator seat is disposed on the top surface of the rear of the tilt floor, so that the operator seat can be disposed closer to the rear end of the vehicle body.

Thus, the above-described structure provides a large space at the front and on the side of the operator seat, and the operability and comfortability can be improved.

According to a second aspect of the invention, the tilt floor is provided with a torsion bar and a gas spring cylinder for assisting and controlling a force for tilting the tilt floor.

According to the second aspect of the invention, the tilt floor is provided with the torsion bar and the gas spring cylinder for assisting and controlling a force for tilting the tilt floor, so that the force for lifting the tilt floor to tilt it can be small, and the tilting operation can be performed with ease.

A third aspect of the invention has a canopy disposed behind the tilt floor, the rear of the tilt floor is attached to a counterweight via a spacer which has tap holes on its top surface for mounting the canopy, tap holes on its bottom surface for mounting the counterweight and tilt floor supports at both ends.

According to the third aspect of the invention, the rear of the tilt floor is attached to the counterweight via the spacer which has the tap holes on its top surface for mounting the canopy, the tap holes on its bottom surface for mounting the counterweight, and the tilt floor supports at both ends. Therefore, the counterweight does not require having the tilt floor supports, and the counterweight does not need to have a wide top surface for mounting the canopy on the counterweight.

Thus, the space for mounting the engine is not decreased, and the headroom of the engine is opened more widely when the tilt floor is tilted toward the front of the vehicle body by the hinge mechanism, so that the maintainability can be improved furthermore.

A fourth aspect of the invention comprises lock means disposed to engage a lock bar of a lock arm, which is supported to pivot by a vehicle body frame, with a lock groove of a lock plate fixed to the tilt floor so to hold the tilt floor in a state turned toward the front of the vehicle body, and double lock means disposed to restrict a relative movement of the lock plate and the lock arm so to prevent the lock bar from falling off the lock groove.

According to the fourth aspect of the invention, the lock means are disposed to engage the lock bar of the lock arm, which is supported to pivot by the vehicle body frame, with the lock groove of the lock plate fixed to the tilt floor so to hold the tilt floor in the state turned toward the front of the vehicle body, and when the tilt floor is tilted up, the tilt floor can be locked not to turn downward, and the safety at the tilting operation can be improved.

As described above, the double lock means are disposed to restrict a relative movement of the lock plate and the lock arm so to prevent the lock bar from falling off the lock groove. Therefore, when the tilt floor is tilted up, the tilt floor can be securely locked so not to turn downward, and the safety at the time of the tilting operation can be improved extensively.

A fifth aspect of the invention has a canopy disposed behind the tilt floor, and the rear of the tilt floor is attached to a counterweight via a spacer on which the canopy is attached.

According to the fifth aspect of the invention, the rear of the tilt floor is attached to the counterweight via the spacer, so that the counterweight does not need to have the tilt floor supports, and the counterweight does not need to have a wide top surface for mounting the canopy on the counterweight.

Thus, the space for mounting the engine is not decreased, and the headroom of the engine is opened more widely when the tilt floor is tilted toward the front of the vehicle body by the hinge mechanism, and the maintainability can be improved furthermore.

A sixth aspect of the invention has a canopy disposed behind the tilt floor, the canopy is attached to a counterweight, and the rear of the tilt floor is attached to the canopy.

According to the sixth aspect of the invention, the space for mounting the engine is not decreased, and when the tilt floor is tilted toward the front of the vehicle body by the hinge mechanism, the headroom of the engine is opened widely, so that the maintainability can be improved further more.

A seventh aspect of the invention has a canopy disposed behind the tilt floor, and the canopy and the rear of the tilt floor are attached to a counterweight.

According to the seventh aspect of the invention, the space for mounting the engine is not decreased, and when the tilt floor is tilted toward the front of the vehicle body by the hinge mechanism, the headroom of the engine is opened widely, and the maintainability can be improved furthermore.

An eighth aspect of the invention comprises lock means and double lock means for holding the tilt floor in a tilted state.

According to the eighth aspect of the invention, the lock means and the double lock means for holding the tilt floor in the tilted state are provided, the lock can be doubly secured to prevent the tilt floor from turning downward, so that the safety at the time of the tilting operation can be secured, and a superior level of safety can be realized.

DESCRIPTION OF THE PREFERRED EMBODIMENTS

Figure 1:
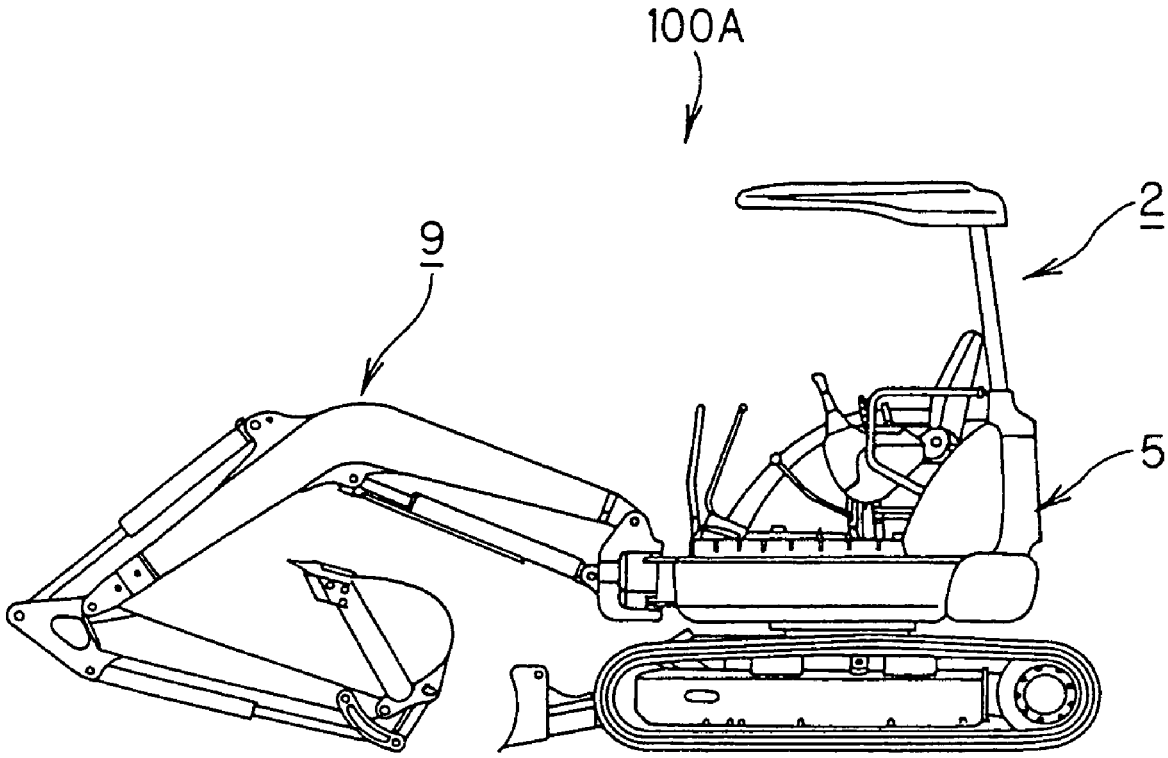
FIG. 1 is a side view showing an example of the work vehicle according to the invention.

Embodiments of a work vehicle having the tilt floor according to the present invention will be described with reference to the accompanying drawings. Like reference numerals are used to indicate like components, and their descriptions will be omitted.

As an example of the work vehicle according to the present invention, a side view of the appearance of a small hydraulic excavator 100A as a small excavation vehicle is shown in FIG. 1. As shown in FIG. 1, a counterweight 5 is disposed on the rear end of a body frame (not shown), and a canopy 2 is positioned on the top surface of the counterweight 5. The counterweight 5 serves to keep a balance of the excavator 100A when a load is applied to a working device 9 which is disposed on the front end of the body frame.

A first embodiment of the invention will be described below with reference to FIG. 2 which shows a mounting structure of the tilt floor. The tilt floor 1 has a hinge mechanism 14 which is disposed on a front end 11 of the tilt floor 1. A rear 12 of the tilt floor 1 is higher than a front 1F of the tilt floor 1 and formed to have a stepped shape so to cover the headroom of an engine 60 which is mounted on the rear of the vehicle body of the small hydraulic excavator 100A. An operator seat 3 is disposed on the top surface of the rear 12 of the tilt floor 1. A lower mounting bracket 21 of the canopy 2 is attached to a rear end 13 of the tilt floor 1 with plural bolts 22. And, the rear end 13 of the tilt floor 1 is attached to the top of the counterweight 5 with bolts 19.

Therefore, when the bolts 19 are removed and the tilt floor 1 is tilted about a hinge pin 14*a* of the hinge mechanism 14 toward the front of the small hydraulic excavator 100A as indicated by a chain double-dashed line, the canopy 2 and the operator seat 3 are turned together with the tilt floor 1. Thus, the headroom of the engine 60 is opened wide, and the maintenance of the engine 60 and its periphery can be made with ease.

As described above, the rear 12 of the tilt floor 1 is configured to have a stepped shape to cover the headroom of the engine 60 which is mounted on the rear of the body of the small hydraulic excavator 100A, and the operator seat 3 is mounted on the top surface of the rear 12 of the tilt floor 1, so that it is easy to mount the operator seat 3 closer to the rear end of the body of the small hydraulic excavator 100A. Thus, by configuring as described above, the space at the front or on the side of the operator seat 3 becomes large, and operability and comfortability can be improved.

Figure 3:
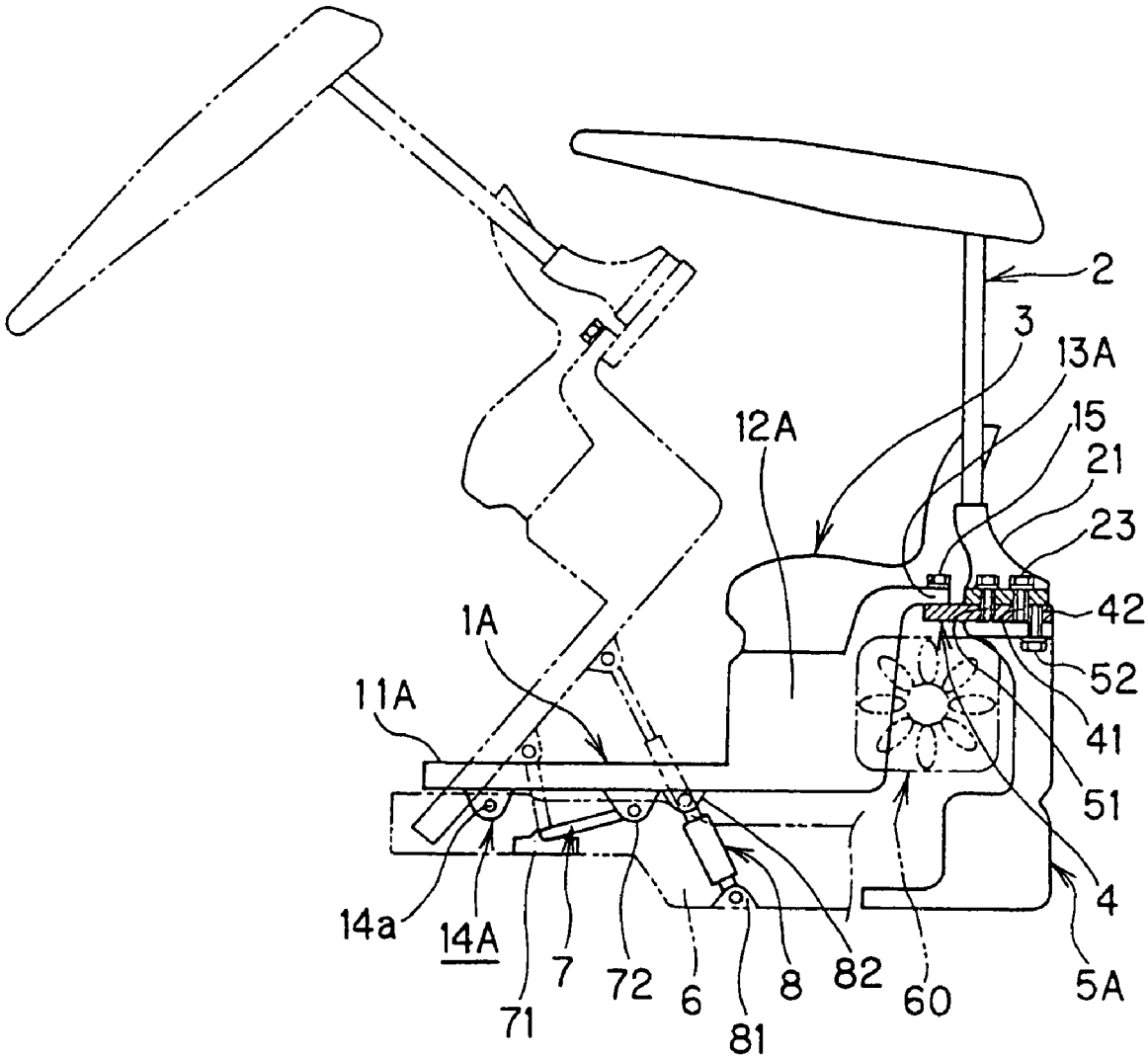
FIG. 3 is a partially sectional view showing a tilt floor mounting structure.
Figure 4:
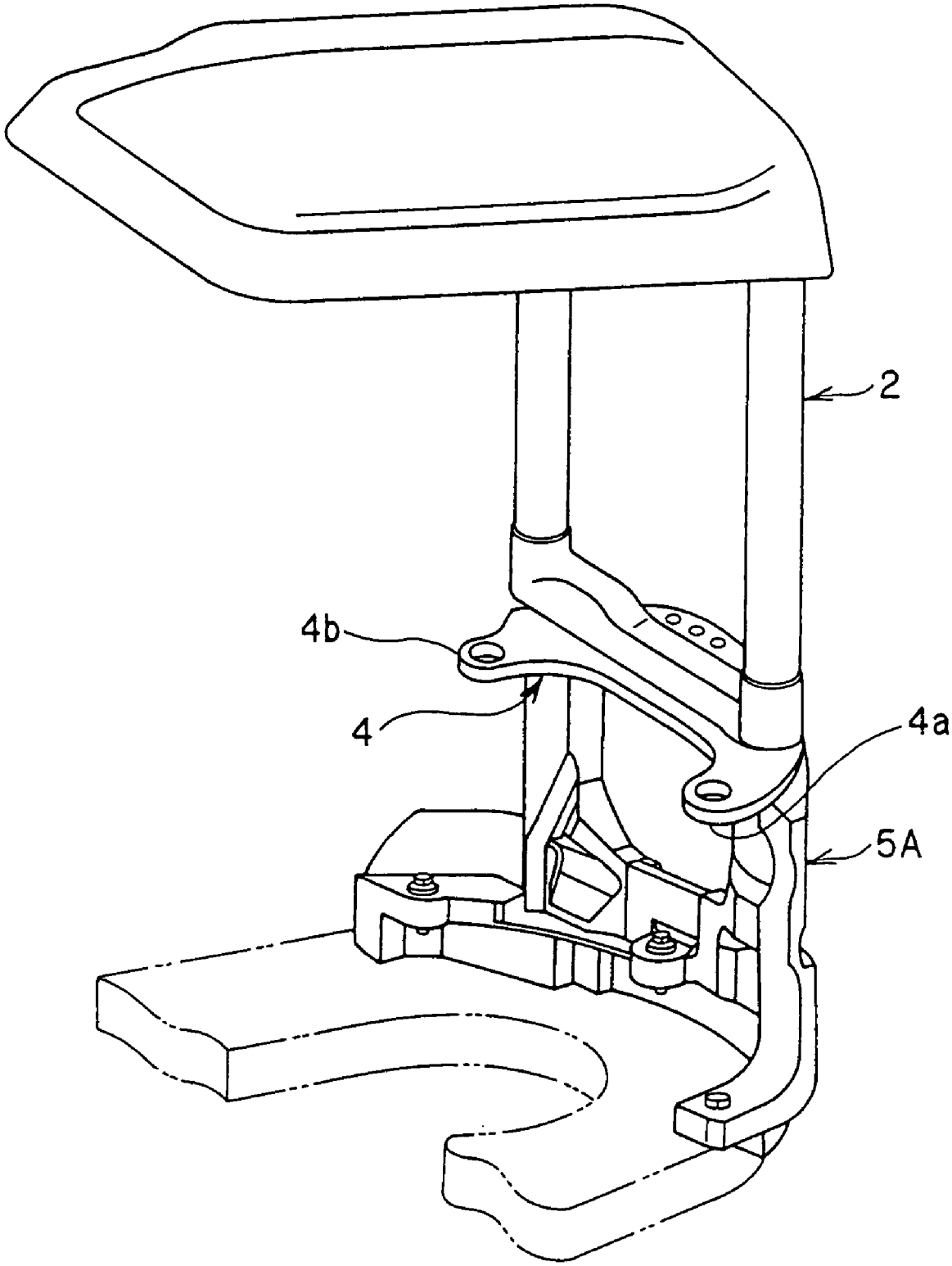
FIG. 4 is a perspective view showing a mounting structure of a counterweight and a canopy.
Figure 5:
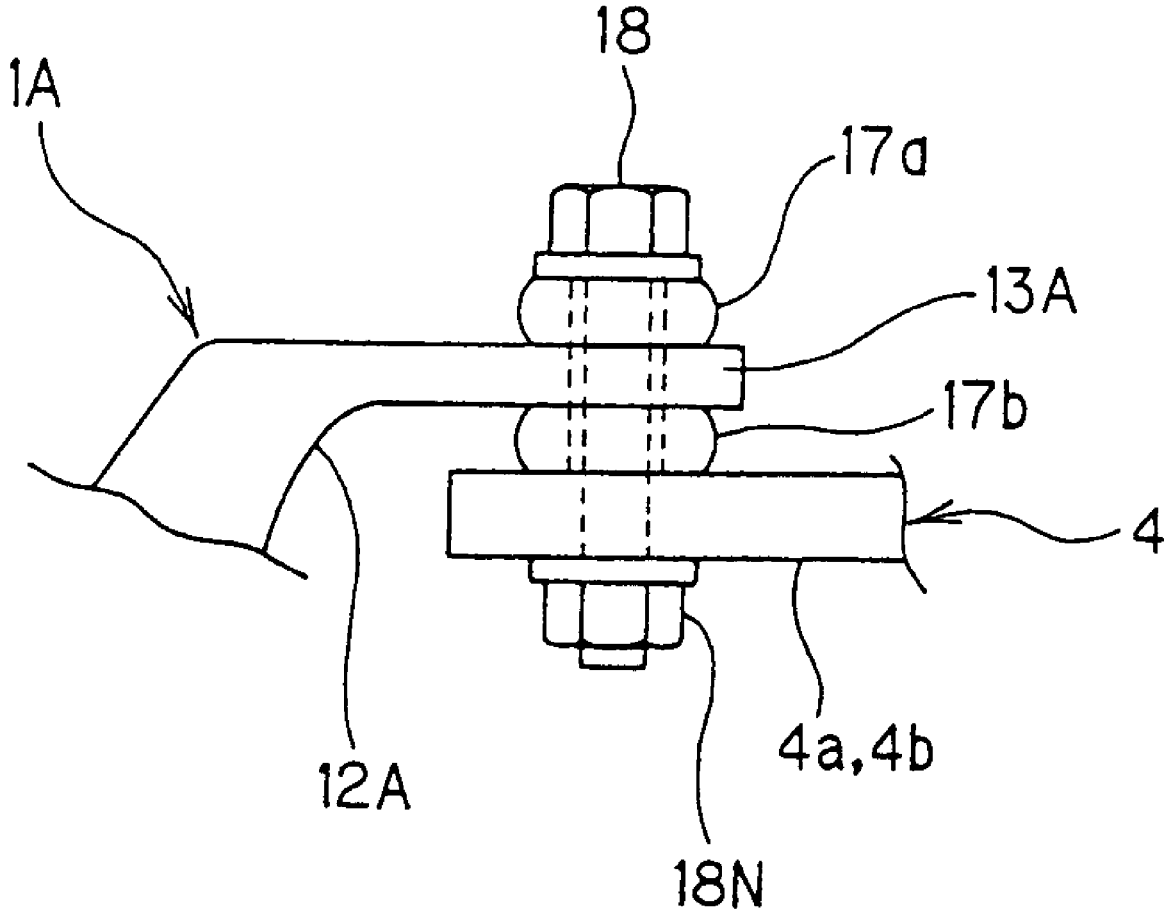
FIG. 5 is an enlarged view of a substantial part showing a mounting structure of the rear end of the tilt floor.
Figure 6:
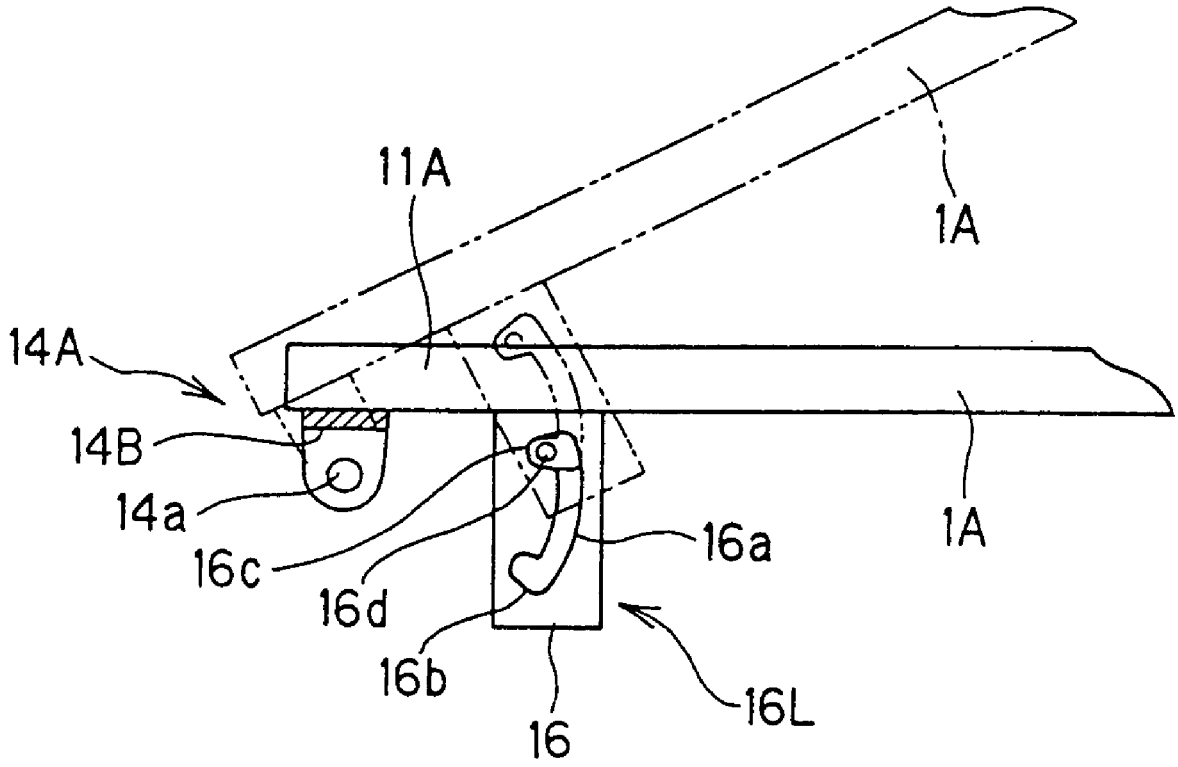
FIG. 6 is a conceptual view of a substantial part showing a locking mechanism of the tilt floor.

A second embodiment of the invention will be described below with reference to FIG. 3 showing a mounting structure of a tilt floor 1A, FIG. 4 showing a mounting structure of a counterweight 5A and the canopy 2, FIG. 5 showing a mounting structure of a rear end 13A of the tilt floor 1A, and FIG. 6 showing a locking mechanism 16L of the tilt floor 1A.

The tilt floor 1A is configured to be attached to the counterweight 5A through a spacer 4 which has multiple canopy mounting tap holes 41 for mounting the canopy 2 on the top surface, multiple counterweight mounting tap holes 42 for mounting the counterweight 5A to the bottom surface, and a left tilt floor support 4*a* and a right tilt floor support 4*b* corresponding to the left and right sides of the tilt floor 1A as shown in FIG. 4.

Specifically, the lower mounting bracket 21 of the canopy 2 is attached to the spacer 4 by means of the multiple canopy mounting tap holes 41 and bolts 23, the tilt floor 1A is attached to the tilt floor supports 4*a*, 4*b* of the spacer 4 by means of bolts 15, and the spacer 4 is attached to a top surface 51 of the counterweight 5A by the multiple counterweight mounting tap holes 42 and bolts 52.

The above-described structure includes the spacer 4, so that the counterweight 5A does not need to have a support for the tilt floor 1A, and it is not necessary to dispose a mounting seat for the canopy 2 on the top surface 51 of the counterweight 5A to attach the canopy 2 to the counterweight 5A. Therefore, the space for housing the engine 60 is not decreased, and when the bolts 52 are removed and the tilt floor 1A is tilted toward the front of the vehicle body as indicated by a two-dot chain line about the hinge pin 14*a* by a hinge mechanism 14A, the headroom of the engine 60 is opened more widely, and the maintainability is improved furthermore.

As shown in FIG. 3, the tilt floor 1A has a torsion bar 7 attached between a bracket 71 disposed on a body frame 6 indicated by a two-dot chain line and a bracket 72 disposed on the tilt floor 1A so to generate a force to turn the tilt floor 1A toward the front of the vehicle body. Besides, a gas spring cylinder 8, which assists the force to turn the tilt floor 1A toward the front of the vehicle body and controls to suppress a turning speed of the tilt floor 1A, is disposed between a bracket 81 disposed on the body frame 6 and a bracket 82 disposed on the tilt floor 1A. Therefore, a force to lift so to tilt to the state as indicated by a two-dot chain line can be small, and the tilting operation can be made easily.

A vibration-isolating structure is adopted to the tilt floor supports 4*a*, 4*b* of the spacer 4 for the tilt floor 1A shown in FIG. 4 so as to support the rear end 13A of a rear 12A of the tilt floor 1A by the spacer 4 with a bolt 18 and a nut 18N through vibration-isolating rubbers 17*a* and 17*b* as shown in FIG. 5. The hinge mechanism 14 is attached to the tilt floor 1A through a vibration-isolating rubber 14B as shown in FIG. 6 to adopt a vibration-isolating structure to the hinge mechanism 14A of a front end 11A of the tilt floor 1A to improve the ride quality and comfortability substantially. And, the vibration-isolating structure of the hinge mechanism 14A may attach the hinge pin 14*a* through an unshown rubber bush.

And, the tilt floor 1A is provided with the lock mechanism 16L, which is provided with a lock plate 16 having an oblong hole 16*a* and lock grooves 16*b*, 16*c*, and a lock bar 16*d*, which is engaged with the lock grooves 16*b*, 16*c* by a force pushed by a spring (not shown) and released by an unshown lever, as shown in FIG. 6.

When the tilt floor 1A is not tilted and in a lowered state, the lock bar 16*d* is automatically engaged with the lock groove 16*c* by an unshown spring. When the tilt floor 1A is tilted toward the front of the vehicle body, the lock bar 16*d* is released from the lock groove 16*c* by an unshown operation lever.

The tilt floor 1A can be locked to the body frame 6 by the lock mechanism 16L so not to turn while it is in the ordinary state, and the tilt floor 1A can be locked so not to turn downward when the tilt floor 1A is being tilted upward. Thus, safety at the tilting operation can be improved.

Figure 7B:
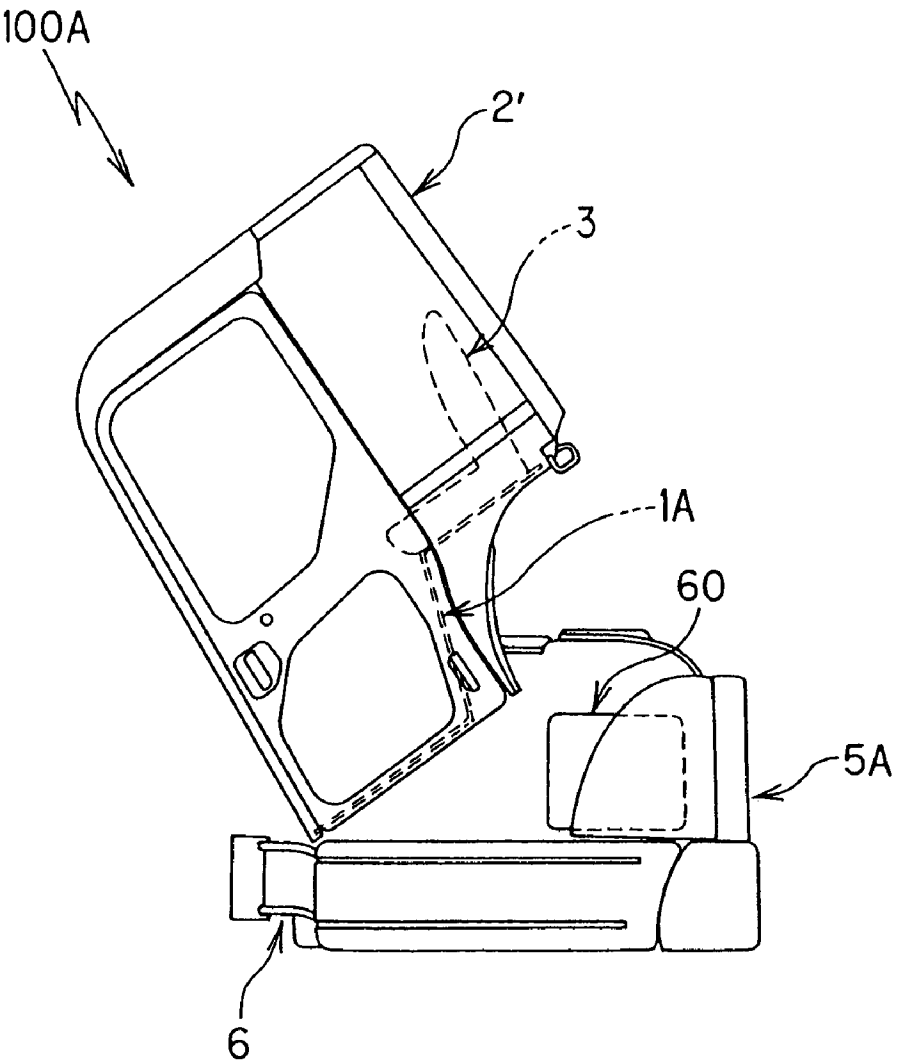
FIGS. 7A and 7B are side views showing a work vehicle having a cabin instead of a canopy.
Figure 7A:
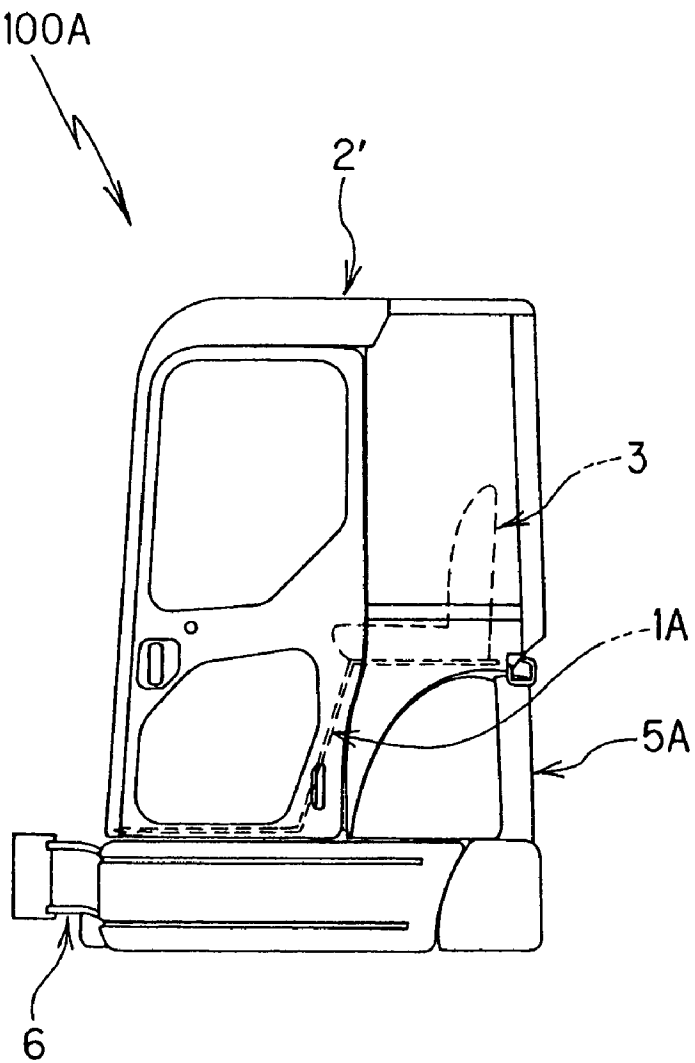

Here, in the embodiment shown in FIG. 3, the open type canopy 2 is attached behind the tilt floor 1A, but a close type cabin 2' can be attached to the tilt floor 1A instead of the canopy 2 as shown in FIG. 7A and FIG. 7B.

Specifically, either the open type canopy 2 or the closed type cabin 2' can be selectively attached to the tilt floor 1A because the spacer 4 is disposed on the rear of the tilt floor 1A.

It is needless to say that the same action and effect as in the embodiment shown in FIG. 3 can be produced even when the closed type cabin 2' is attached to the tilt floor 1A.

Figure 2:
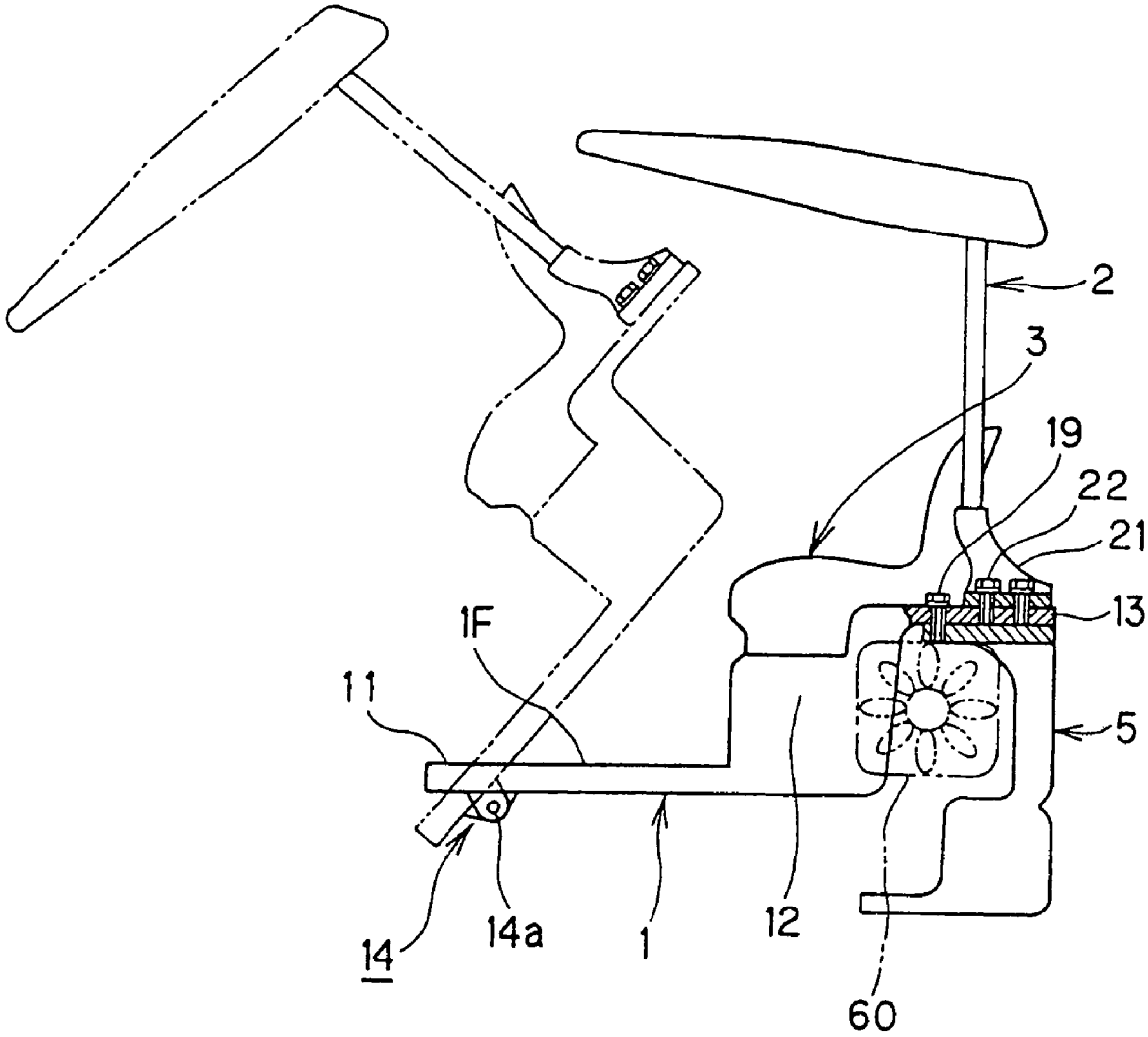
FIG. 2 is a partially sectional view showing a tilt floor mounting structure.

The open type canopy 2 is attached to the rear of the tilt floor 1 in the embodiment shown in FIG. 2, but the closed type cabin can be attached instead of the canopy 2 to the tilt floor 1.

FIG. 8 to FIG. 11 show a lock mechanism 17L which is a modified example of the lock mechanism 16L shown in FIG. 6. This lock mechanism 17L has a lock plate 17 which is fixed to the tilt floor 1A and a lock arm 17A which is supported to pivot by the body frame 6 through a supporting pin 17*e*.

An oblong hole 17*a* and lock grooves 17*b*, 17*c* are formed in the lock plate 17, a lock bar 17*d* and an operation lever 171 are attached to the lock arm 17A, and the lock arm 17A is pushed by a spring (not shown) in a direction indicated by arrow R to engage the lock bar 17*d* with the lock grooves 17*b*, 17*c*.

A stopper plate 17B is pivotably supported by the lock plate 17 via a supporting pin 17*p*, an engagement shoulder 17Ba is formed at a free end of the stopper plate 17B, and the supporting pin 17*p* and the stopper plate 17B configure a double lock means 17W.

Figure 8:
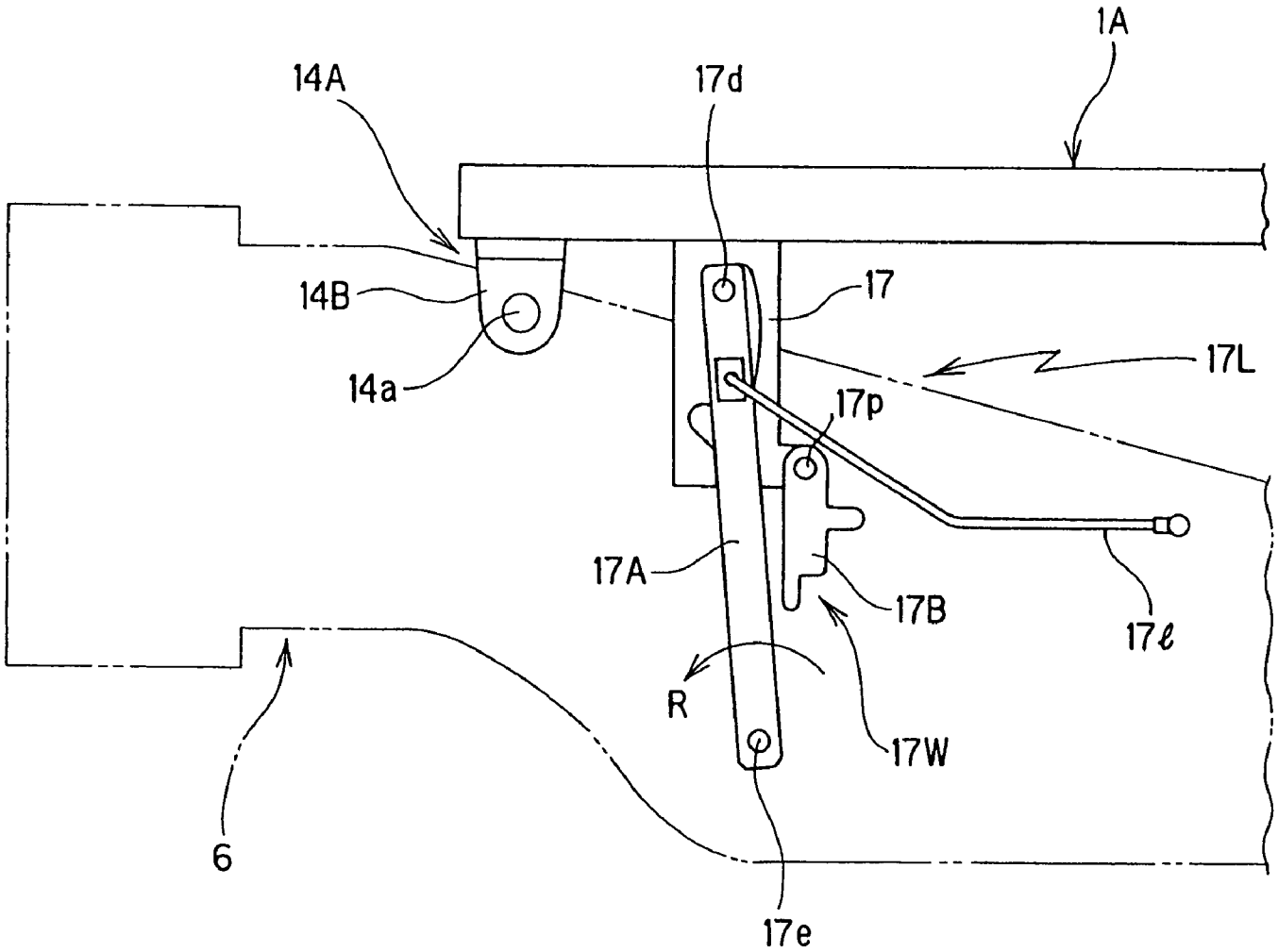
FIG. 8 is a conceptual view of a substantial part showing another embodiment of the locking mechanism.
Figure 9:
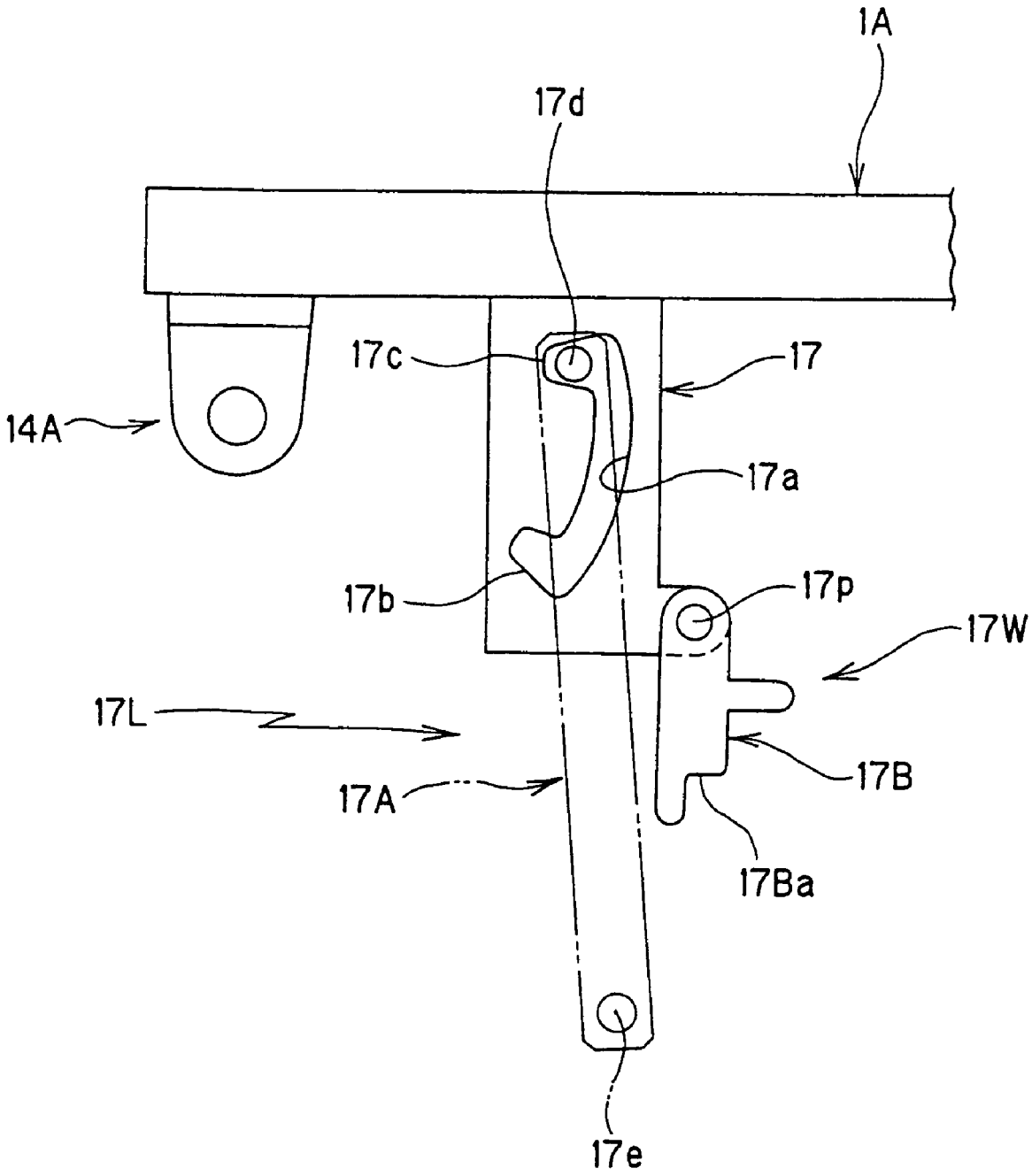
FIG. 9 is a conceptual view showing an operation mode of the locking mechanism shown in FIG. 8.
Figure 10:
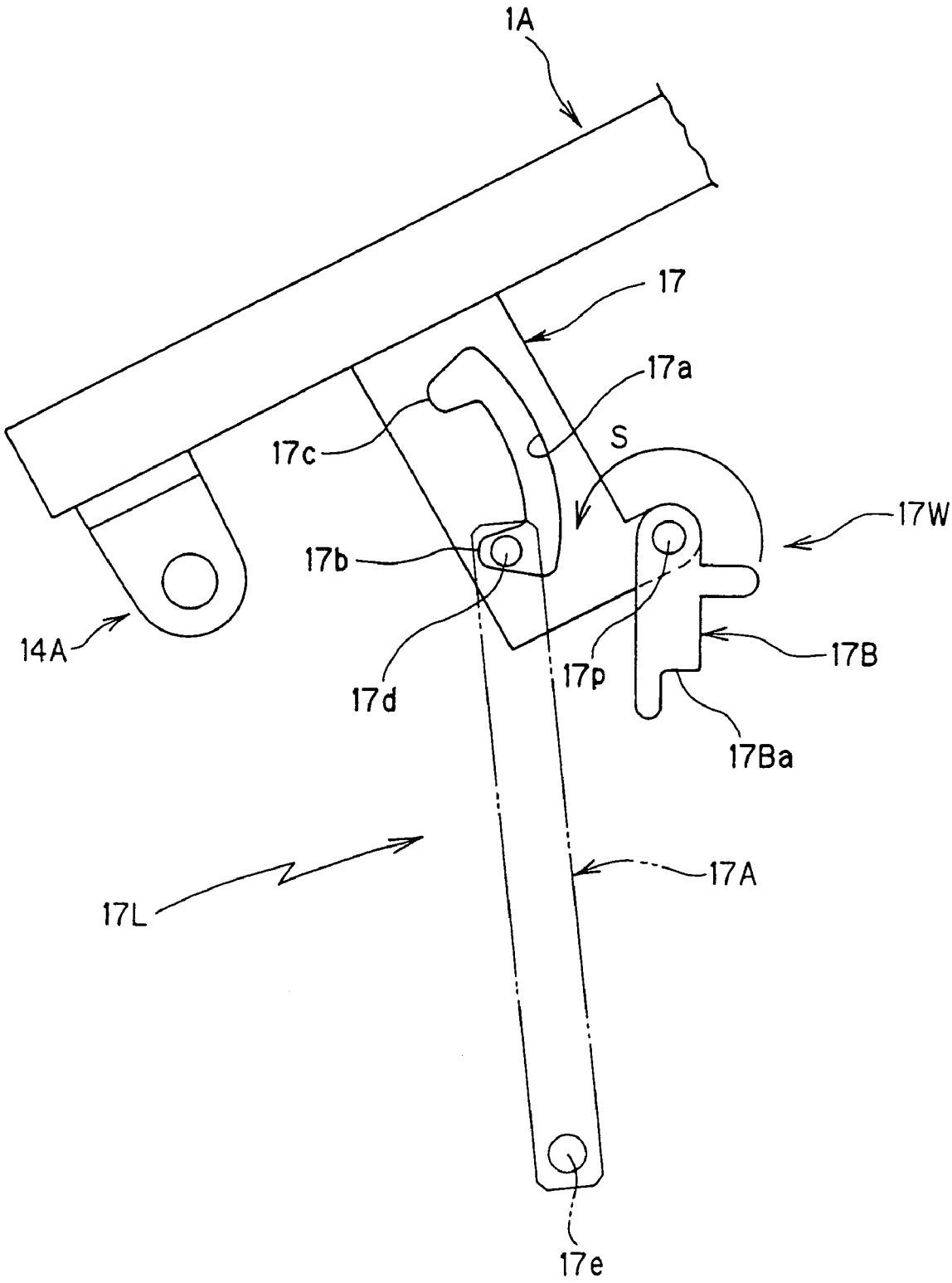
FIG. 10 is a conceptual view showing an operation mode of the locking mechanism shown in FIG. 8.

As shown in FIG. 8 and FIG. 9, when the tilt floor 1A is down (non-tilted state), the lock bar 17*d* of the lock arm 17A is in engagement with the lock groove 17*c* of the lock plate 17, and the tilt floor 1A is locked in a prescribed position.

Meanwhile, to tilt up the tilt floor 1A by turning toward the front of the vehicle body, the operation lever 17*l* is pulled to pivot the lock arm 17A, the lock bar 17*d* is pulled out from the lock groove 17*c*, the tilt floor 1A is turned toward the front of the vehicle body, the lock bar 17*d* is engaged with the lock groove 17*b* of the lock plate 17 by the pushing force of a spring (not shown), and the tilt floor 1A is automatically locked in a tilt-up state.

Thus, the tilt floor 1A can be locked so not to turn downward when the tilt floor 1A is tilted up, so that safety at the time of the tilting operation is improved.

Figure 11:
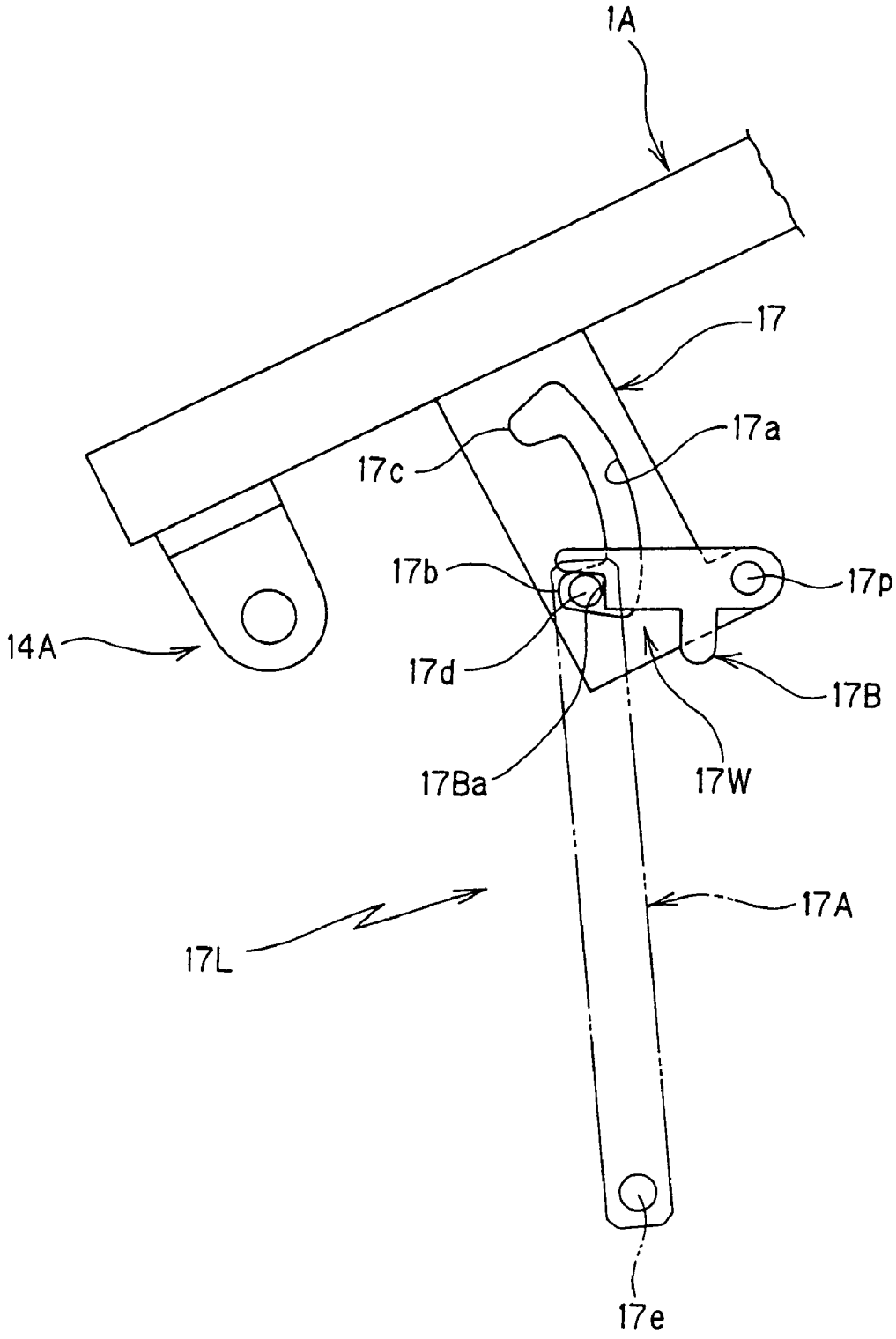
FIG. 11 is a conceptual view showing an operation mode of the locking mechanism shown in FIG. 8.

Besides, when the lock bar 17*d* is in engagement with the lock groove 17*b* of the lock plate 17, the stopper plate 17B is manually pivoted by an operator in a direction indicated by arrow S to engage the engagement shoulder 17Ba of the stopper plate 17B with the lock bar 17*d* as shown in FIG. 11. Thus, the relative movement of the lock plate 17 and the lock arm 17A is restricted, and the lock bar 17*d* can be securely prevented from falling out of the lock groove 17*b*.

As described above, the engaged state of the lock bar 17*d* with the lock groove 17*b* can be visually checked when the stopper plate 17B is manually operated by the operator, and the lock bar 17*d* can be prevented securely from falling from the lock groove 17*b* by the stopper plate 17B, and safety at the time of the tilting operation can be improved extensively.

FIG. 12 to FIG. 15 show a lock mechanism 18L which is another modified example of the lock mechanism 16L shown in FIG. 6. In the lock mechanism 18L, a lock plate 18 is formed a stopper hole 18*o*, and a lock arm 18A is also formed a stopper hole 18Ao.

And, the lock arm 18A is provided with a holder bracket 18Ah, a stopper pin 18B which is connected to a chain 18*f* is removably held by the holder bracket 18Ah, and the stopper pin 18B and the stopper holes 18*o*, 8Ao configure a double lock means 18W.

The structure other than that of the lock mechanism 18L described above is basically the same as that of the lock mechanism 17L described with reference to FIG. 8 to FIG. 11, so that the components of the lock mechanism 18L having the same functions as those of the lock mechanism 17L are designated by reference numerals of eighteens with "1" added to the reference numerals used in FIG. 8 to FIG. 11, and their detailed descriptions will be omitted.

Figure 12:
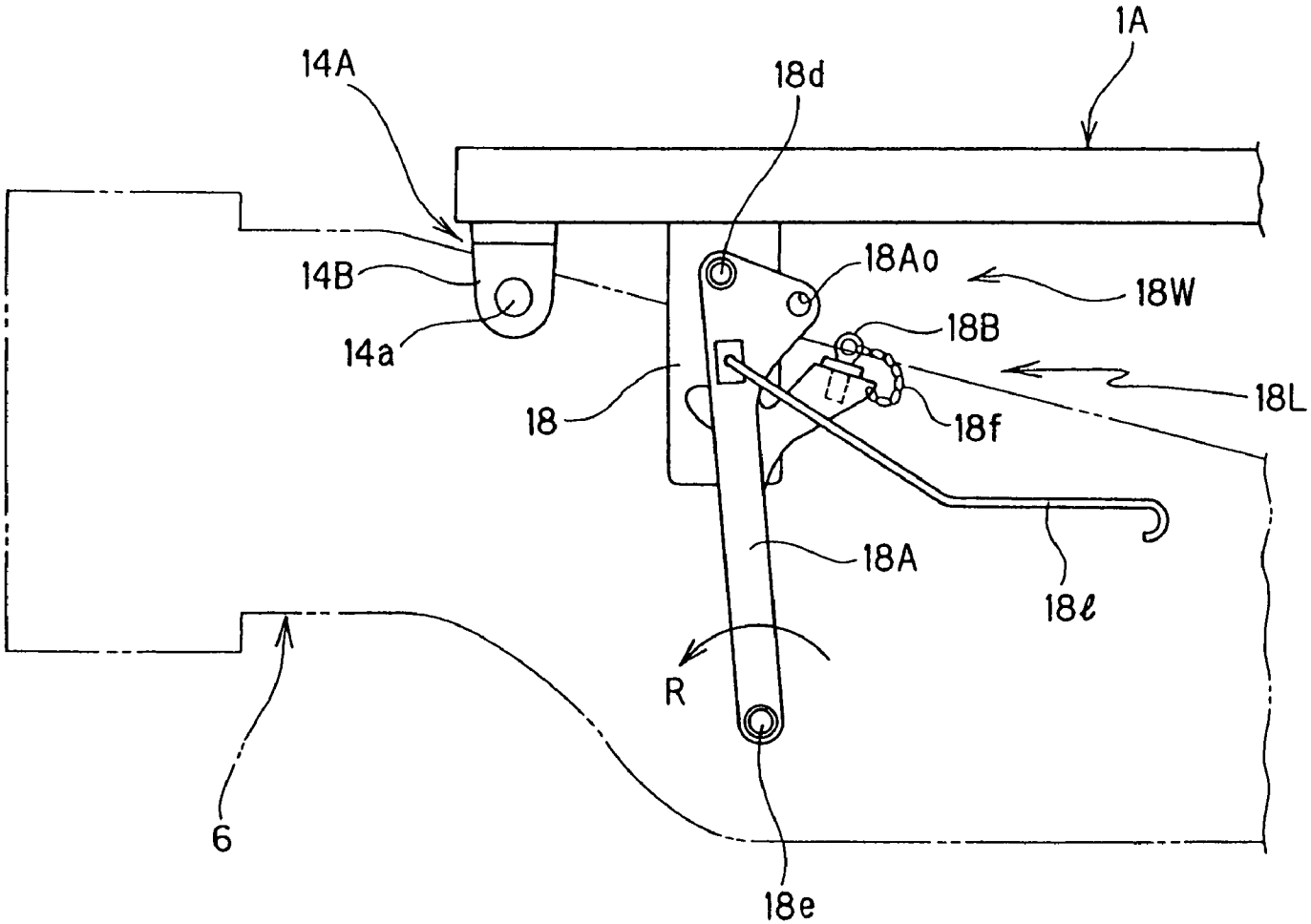
FIG. 12 is a conceptual view of a substantial part showing a still another embodiment of the locking mechanism.
Figure 13:
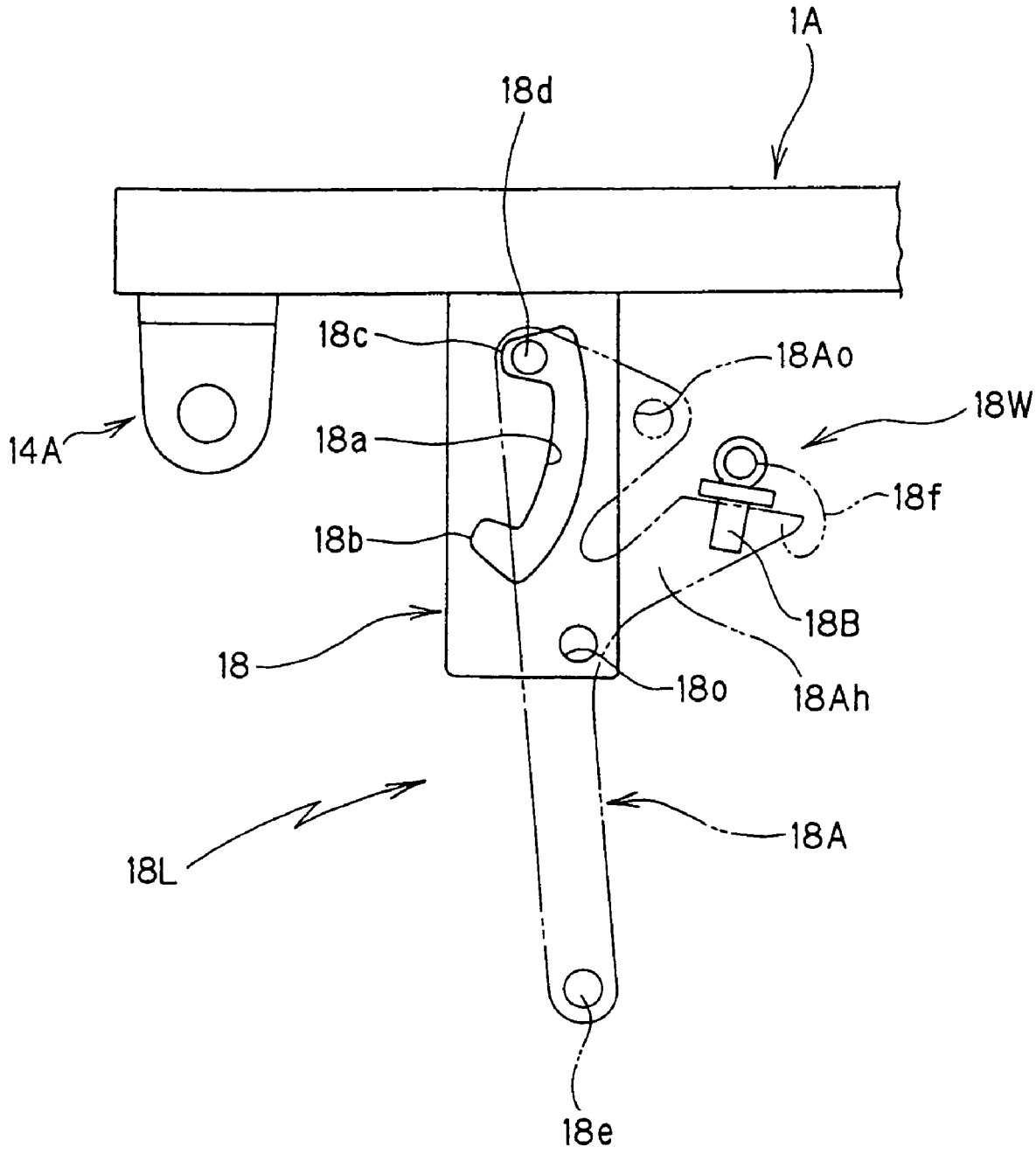
FIG. 13 is a conceptual view showing an operation mode of the locking mechanism shown in FIG. 12.
Figure 14:
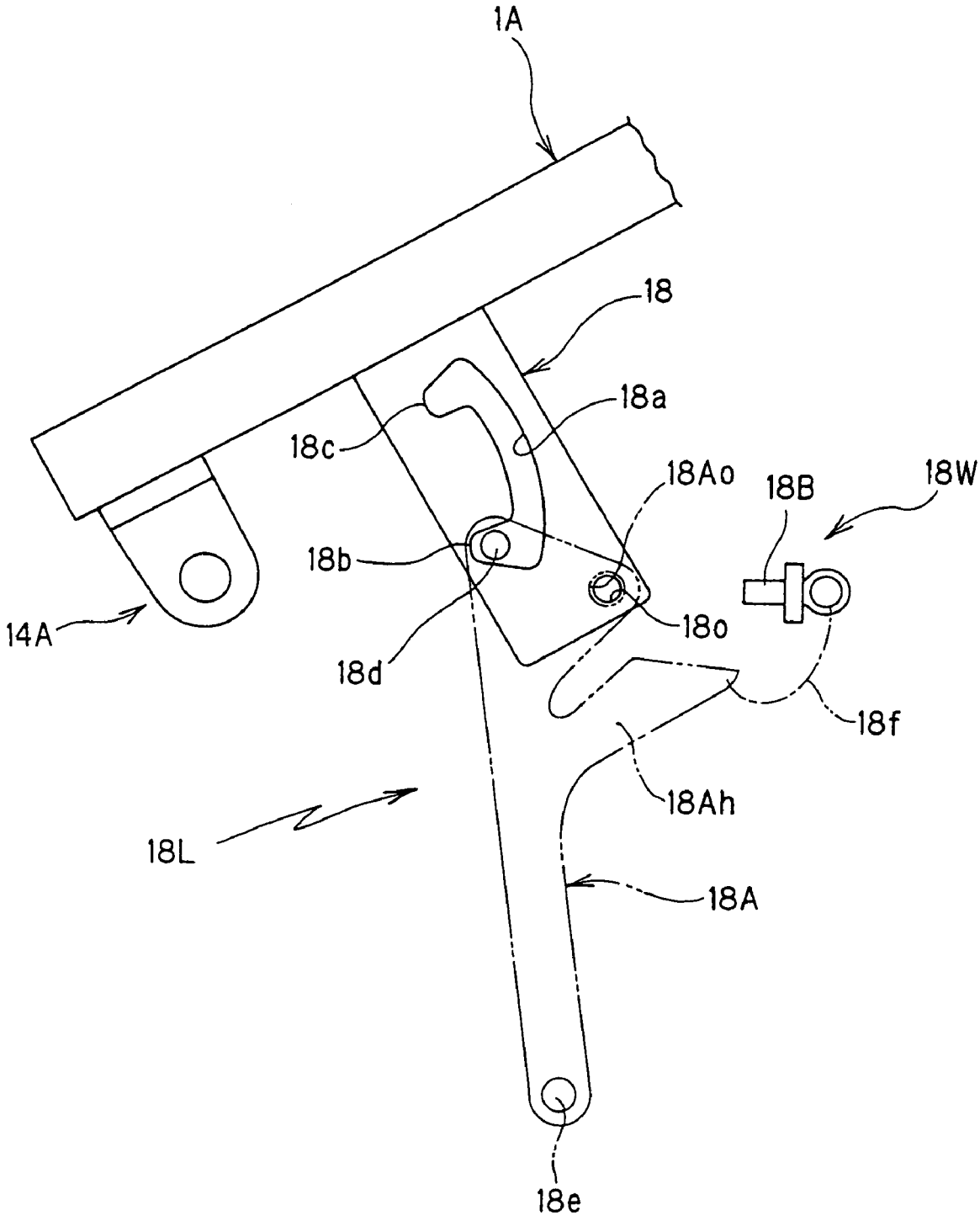
FIG. 14 is a conceptual view showing an operation mode of the locking mechanism shown in FIG. 12.
Figure 15:
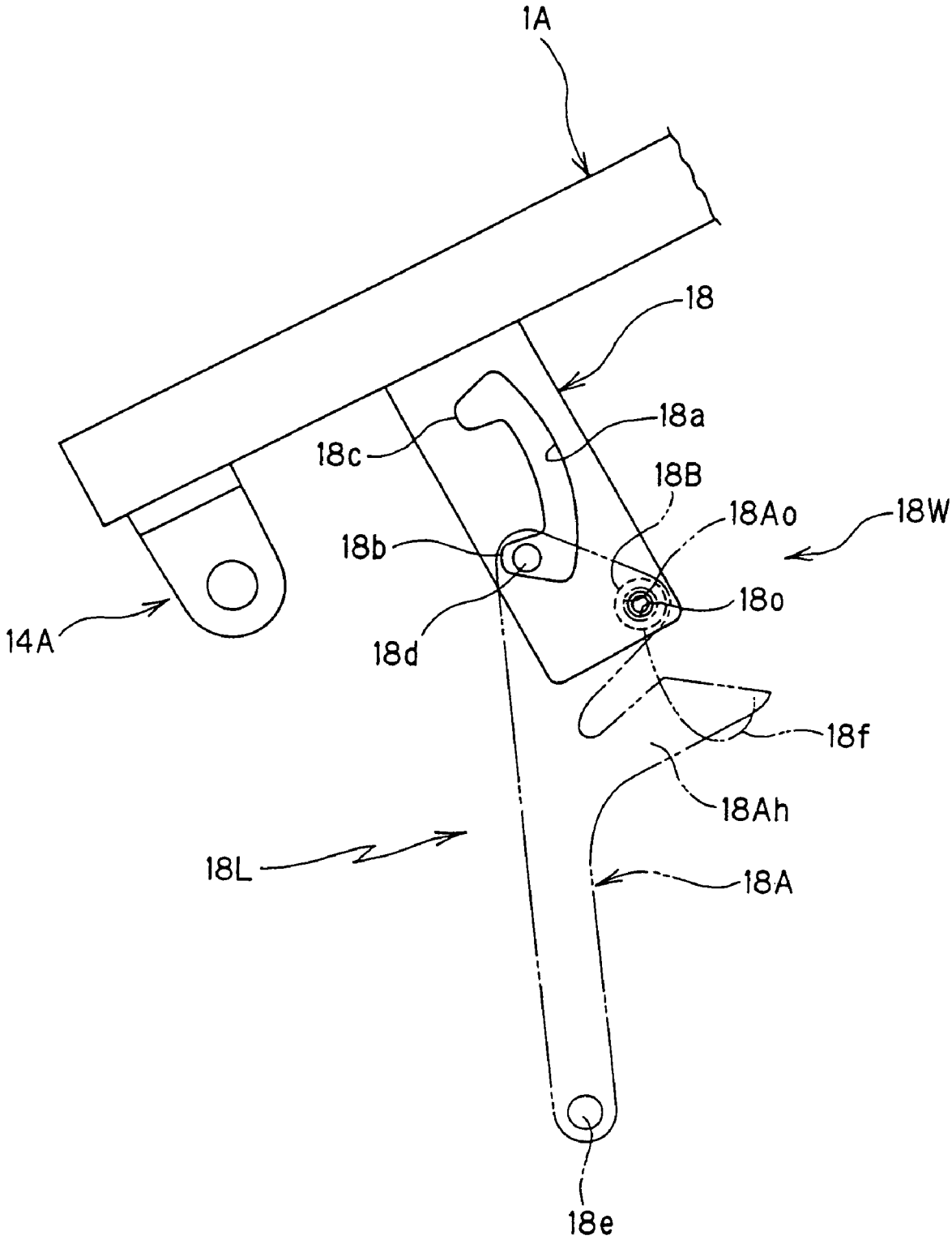
FIG. 15 is a conceptual view showing an operation mode of the locking mechanism shown in FIG. 12.

As shown in FIG. 12 and FIG. 13, when the tilt floor 1A is down (non-tilted state), a lock bar 18*d* of the lock arm 18A is in engagement with a lock groove 18*c* of the lock plate 18, and the tilt floor 1A is locked in a prescribed position.

Meanwhile, when the tilt floor 1A is tilted up by turning toward the front of the vehicle body, the operation lever 18*l* is pulled to pivot the lock arm 18A, the lock bar 18*d* is pulled out from the lock groove 18*c*, the tilt floor 1A is turned toward the front of the vehicle body, the lock bar 18*d* is engaged with a lock groove 18*b* of the lock plate 18 by the pushing force of a spring (not shown), and the tilt floor 1A is automatically locked in a tilt-up state.

Thus, the tilt floor 1A can be locked so not to turn downward when the tilt floor 1A is tilted up, so that safety at the time of the tilting operation is improved.

Besides, when the lock bar 18*d* is in engagement with the lock groove 18*b* of the lock plate 18, the stopper hole 18*o* of the lock plate 18 and the stopper hole 18Ao of the lock arm 18A agree with each other. Then, the stopper pin 18B removed from the holder bracket 18A*h* is manually inserted by the operator into the stopper hole 18*o* and the stopper hole 18Ao which are mutually overlapped to restrict the relative movement of the lock plate 18 and the lock arm 18A. Thus, the lock bar 18*d* can be securely prevented from falling out of the lock groove 18*b*.

As described above, the engaged state of the lock bar 18*d* with the lock groove 18*b* can be visually checked when the stopper pin 18B is manually operated by the operator, and the lock bar 18*d* can be prevented securely from falling from the lock groove 18*b* by the stopper pin 18B, and safety at the time of the tilting operation can be improved extensively.

Then, a modified example 1 of the mounting structure of the tilt floor of the second embodiment will be described with reference to FIG. 16.

In the second embodiment described above, it was configured that the tilt floor 1A was attached to the counterweight 5A via the spacer 4 as shown in FIG. 3. But, the tilt floor 1A may be configured to be attached to a lower mounting bracket 21*a* of the canopy 2*a* which is attached to the counterweight 5A as shown in FIG. 16.

In such a structure, plural internal threads 21*a*11 for screwing the bolts 52 for attaching the canopy 2*a* to the top surface 51 of the counterweight 5A are threaded upward in the lower mounting bracket 21*a* of the canopy 2*a*.

And, the lower mounting bracket 21*a* of the canopy 2*a* is formed a mounting flange 21*a*1 extending forward from both ends of the lower mounting bracket 21*a*, and a pair of internal threads (not shown) for screwing bolts 15 for attaching the tilt floor 1A are threaded downward in the mounting flange 21*a*1.

In the above-described structure, to attach the canopy 2*a* to the counterweight 5A, the plural bolts 52 passed through the holes for attaching the counterweight 5A from below are screwed into the internal threads 21*a*11 of the lower mounting bracket 21*a* of the canopy 2*a* to attach the canopy 2*a* to the top surface 51 of the counterweight 5A.

The tilt floor 1A is attached to the mounting flange 21*a*1 of the lower mounting bracket 21*a* mounted on the counterweight 5A with the pair of bolts 15 inserted through the attaching holes of the rear end 13A of the tilt floor 1A.

Figure 16:
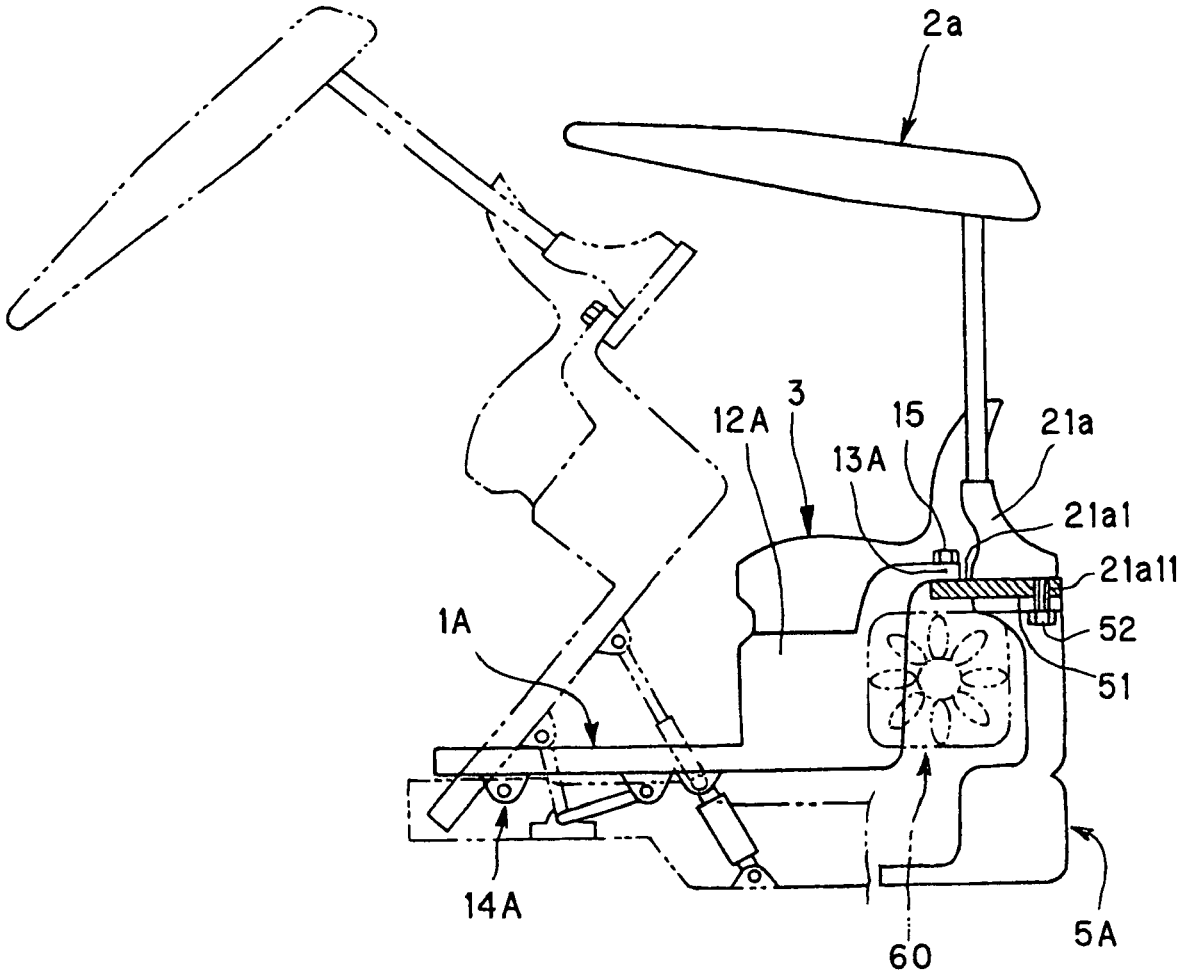
FIG. 16 is a partial sectional view showing a mounting structure of the tilt floor of a modified example 1 of a second embodiment of the invention.

According to the above-described structure, to performance maintenance, the bolts 52 are removed, and the tilt floor 1A is tilted together with the canopy 2*a* as indicated by a two-dot chain line in FIG. 16, so that the headroom of the engine 60 is opened widely. Thus, the maintenance work is facilitated, and the maintainability is remarkable.

And, the bolts 52 are removed, the canopy 2*a* is separated from the counterweight 5A, and the above-described cabin may be attached instead of the canopy 2*a* to the counterweight 5A with the bolts 52.

Then, a modified example 2 of the tilt floor mounting structure according to the second embodiment will be described with reference to FIG. 17.

In this structure, a canopy 2*b* and the tilt floor 1A are attached to a top surface 5B11 of a counterweight 5B.

In the structure, plural internal threads 21*b*1 for screwing the bolts 52 for attaching the canopy 2*b* to the top surface 5B11 of the counterweight 5B are threaded upward in the lower mounting bracket 21*b* of the canopy 2*b*.

And, a mounting flange 5B1 protruding forward from the both ends of the counterweight 5B is formed on the top of the counterweight 5B, and a pair of internal threads (not shown) in which the bolts 15 for attaching the tilt floor 1A are screwed are threaded downward in the mounting flange 5B1.

In this structure, to attach the canopy 2*b* to the counterweight 5B, the plural bolts 52 passed through the attaching holes of the counterweight 5B from below are screwed into the internal threads 21*b*1 of the lower mounting bracket 21*b* of the canopy 2*b*. Thus, the canopy 2*b* is attached to the top surface 5B11 of the counterweight 5B.

The tilt floor 1A is attached to the top surface 5B11 of the counterweight 5B with the pair of bolts 15 which are passed through the attaching holes of the rear end 13A of the tilt floor 1A.

Figure 17:
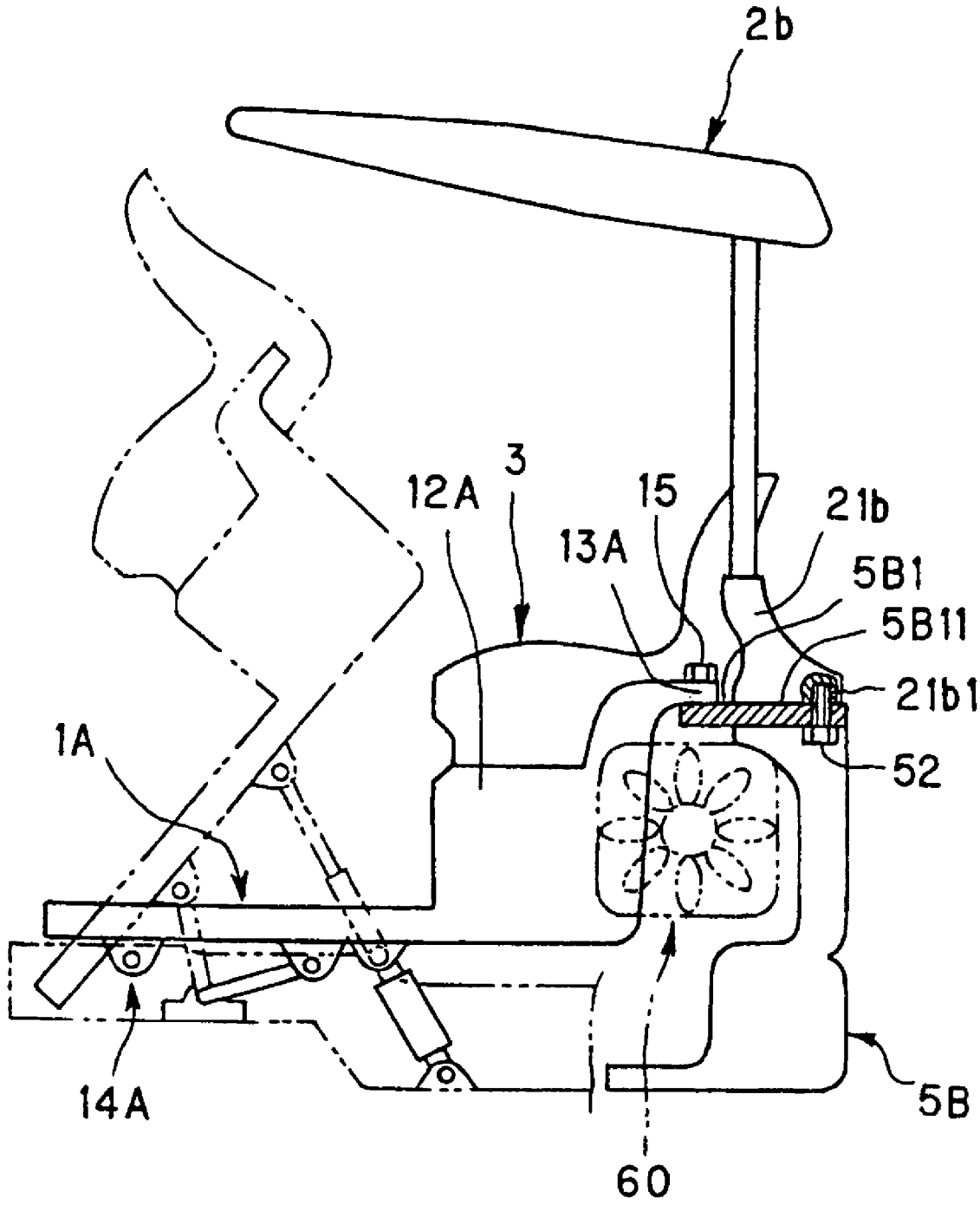
FIG. 17 is a partially sectional view showing a mounting structure of the tilt floor of a modified example 2 of the second embodiment of the invention.
Figure 18:
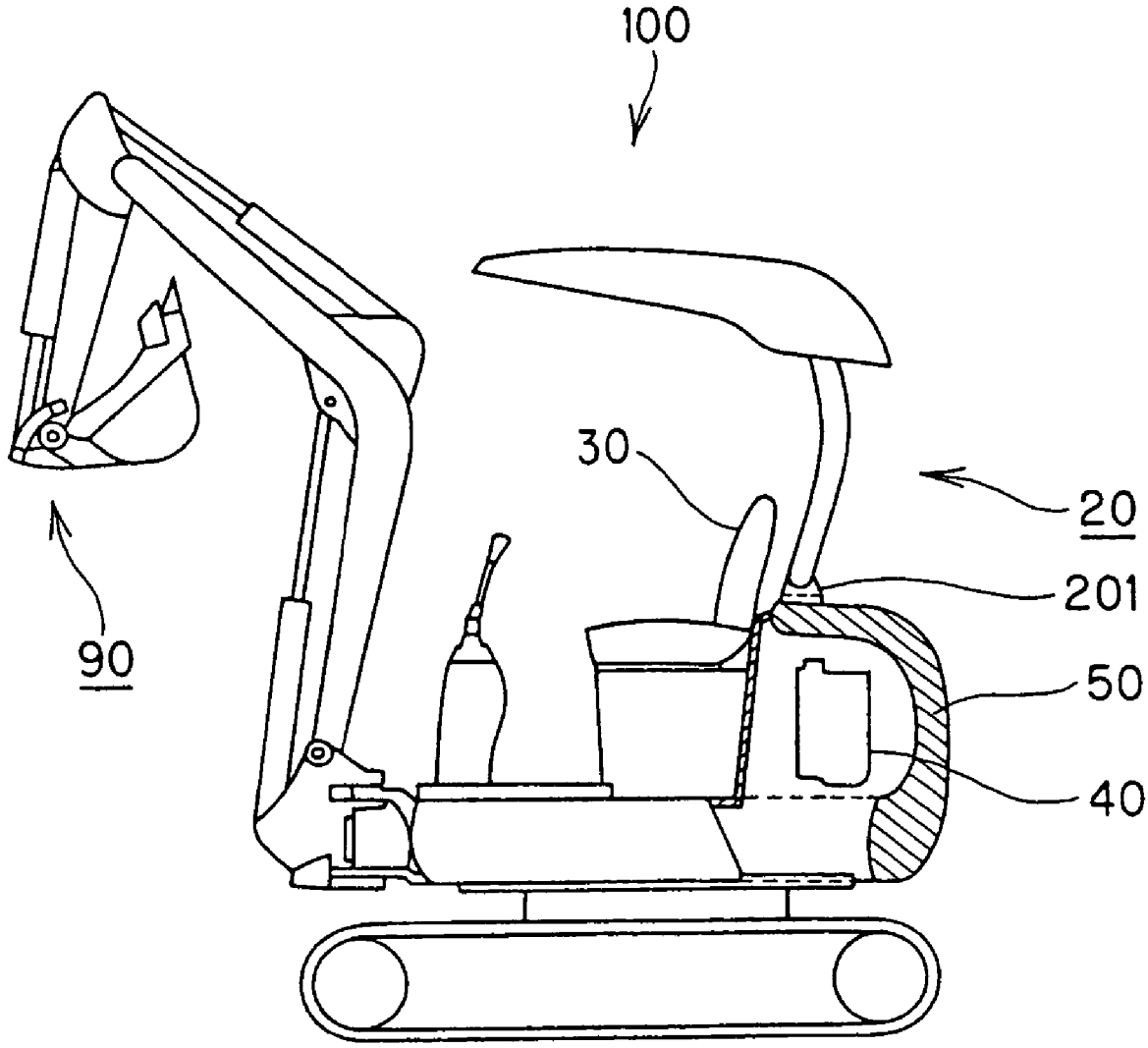
FIG.18 PRIOR ART
FIG. 18 is a side view showing an example of a conventional work vehicle.

According to the above structure, to perform maintenance, the bolts 15 are removed, and the tilt floor 1A is tilted as indicated by a two-dot chain line in FIG. 17, so that the headroom of the engine 60 is opened widely. Thus, the maintenance work is facilitated, and the maintainability is remarkable.

And, the bolts 52 are removed, the canopy 2*b* is separated from the counterweight 5B, and the above-described cabin may be attached instead of the canopy 2*b* to the counterweight 5B with the bolts 52.

In the modified examples 1, 2 of the mounting structure of the tilt floor 1A of the second embodiment, it is needless to say that the lock means 17L, 18L and double lock means 17*w*, 18*w* can be applied at the same time. And, the tilt floor 1A is double-locked in the tilted state, so that the maintenance can be performed more safely, and the superior level of safety at the time of maintenance can be secured.

And, in the previous embodiment, the lock means 17L, 18L and the double lock means 17*w*, 18*w* for holding the lock means 17L, 18L in the locked state were exemplified as the double lock means for holding the tilt floor 1A in the tilted state. But, the double lock means 17*w*, 18*w* can be determined as a second lock means for holding the tilt floor 1A in the tilted state independent of the lock means 17L, 18L.

As described above, the lock means 17L, 18L and the double lock means 17*w*, 18*w* are not limited to the exemplified structures and can have different structures.

What is claimed is:

1. A work vehicle provided with a tilt floor, wherein a hinge mechanism is provided on a front end of the tilt floor to enable turning of the tilt floor toward a front of a vehicle body, a rear of the tilt floor is formed to be higher than the front of the tilt floor so to cover a headroom of an engine disposed on a rear of the vehicle body, an operator seat is disposed on a top surface at the rear of the tilt floor, and a rear end of the tilt floor is attached to an upper part of a counterweight located at a rear of the work vehicle.

2. The work vehicle provided with a tilt floor according to claim 1, wherein the tilt floor is provided with a torsion bar and a gas spring cylinder for assisting and controlling a force for filling the tilt floor.

3. The work vehicle provided with a tilt floor according to claim 1, comprising lock means and double lock means for holding the tilt floor in a tilted state.

4. The work vehicle provided with a tilt floor according to claim 1, wherein a canopy is disposed behind the tilt floor, and the rear of the tilt floor is attached to the counterweight via a spacer on which the canopy is attached.

5. The work vehicle provided with a tilt floor according to claim 1, wherein a canopy is disposed behind the tilt floor, the canopy is attached to the counterweight, and the rear of the tilt floor is attached to the canopy.

6. The work vehicle provided with a tilt floor according to claim 1, wherein a canopy is disposed behind the tilt floor, and the canopy and the rear of the tilt floor are attached to the counterweight.

7. A work vehicle provided with a tilt floor, wherein a hinge mechanism is provided on a front end of the tilt floor to enable turning of the tilt floor toward a front of a vehicle body, a rear of the tilt floor is formed to be higher than a front of the tilt floor so to cover a headroom of an engine disposed on a rear of the vehicle body, an operator seat is disposed on a top surface at the rear of the tilt floor, a canopy is disposed behind the tilt floor, and the rear of the tilt floor is attached to a counterweight via a spacer which has tap holes on its top surface for mounting the canopy, and tap holes on its bottom surface for mounting the counterweight and tilt floor supports at both ends.

8. The work vehicle provided with a tilt floor according to claim 7, comprising lock means and double lock means for holding the tilt floor in a tilted state.

9. A work vehicle provided with a tilt floor, wherein a hinge mechanism is provided on a front end of the tilt floor to enable turning of the tilt floor toward a front of a vehicle body, a rear of the tilt floor is formed to be higher than a front of the tilt floor so to cover a headroom of an engine disposed on a rear of the vehicle body, an operator seat is disposed on a top surface at the rear of the tilt floor, lock means are disposed to engage a lock bar of a lock arm, which is supported to pivot by a vehicle body frame, with a lock groove of a lock plate fixed to the tilt floor so to hold the tilt floor in a state turned toward the front of the vehicle body, and double lock means are disposed to restrict a relative movement of the lock plate and the lock arm so to prevent the lock bar from falling off the lock groove.

* * * * *